US008888512B2

(12) United States Patent
Hoffmeister

(10) Patent No.: US 8,888,512 B2
(45) Date of Patent: Nov. 18, 2014

(54) POWER-TRACK ADAPTER

(71) Applicant: Oliver Hoffmeister, Luedenscheid (DE)

(72) Inventor: Oliver Hoffmeister, Luedenscheid (DE)

(73) Assignee: Hoffmeister Leuchten GmbH, Schalksmuehle (DE)

( * ) Notice: Subject to any disclaimer, the term of this patent is extended or adjusted under 35 U.S.C. 154(b) by 29 days.

(21) Appl. No.: 13/859,483

(22) Filed: Apr. 9, 2013

(65) Prior Publication Data

US 2014/0134856 A1 May 15, 2014

(30) Foreign Application Priority Data

Apr. 11, 2012 (DE) ..... 10 2012 007 084

(51) Int. Cl.
*H01R 25/00* (2006.01)
*H01R 25/14* (2006.01)

(52) U.S. Cl.
CPC ..... *H01R 25/14* (2013.01); *H01R 25/142* (2013.01)
USPC ..... 439/121

(58) Field of Classification Search
CPC ..... H01R 25/14; H01R 25/142
USPC ..... 439/119, 110, 121, 122, 188
See application file for complete search history.

(56) References Cited

U.S. PATENT DOCUMENTS

| | | | | | |
|---|---|---|---|---|---|
| 4,979,081 | A * | 12/1990 | Leach et al. | ..... | 362/219 |
| 5,664,876 | A * | 9/1997 | Vafai et al. | ..... | 362/249.01 |
| 5,903,426 | A * | 5/1999 | Ehling | ..... | 361/119 |
| 6,042,399 | A * | 3/2000 | Jaakkola | ..... | 439/122 |
| 6,203,339 | B1 * | 3/2001 | Nieminen | ..... | 439/118 |
| 7,320,610 | B2 * | 1/2008 | Boike | ..... | 439/121 |

FOREIGN PATENT DOCUMENTS

DE 2250738 A 4/1974

* cited by examiner

*Primary Examiner* — Phuongchi T Nguyen
(74) *Attorney, Agent, or Firm* — Andrew Wilford

(57) ABSTRACT

An adapter for use with a U-section longitudinally extending power track has a base adapted to fit in the slot and a head adapted to fit outside the slot on the track so that an electrical device can be connected via the adapter to the conductors in the track. A first operating shaft extending along and pivotal about an axis in the housing carries contact fingers pivotal on rotation of the first shaft between a retracted position recessed in the base and a contacting position projecting from the base and, when the base is fitted to the slot, engaging the conductors. A second operating shaft extends along and pivotal about the axis in the housing. A second switch assembly connected to the second shaft and operable thereby on rotation of the second operating shaft to connect and disconnect the contact fingers with phase contacts on the housing.

7 Claims, 10 Drawing Sheets

POWER-TRACK ADAPTER

FIELD OF THE INVENTION

The present invention relates to an adapter for a power track. More particularly this invention concerns such an adapter for a multipole power track.

BACKGROUND OF THE INVENTION

An adapter for a multipole U-section power track has a base that can be inserted into the slot of the power track and a head that sits outside the power track and to which an electrical device may be connected. A first operating shaft in the base has contact fingers for contacting electrical conductors provided in the power track and can move from a retracted position pivoted into the base to an outwardly pivoted contact position. A second switch assembly that can form a phase connection to a contact finger on phase is selectively contacted with the contact finger applied to the neutral conductor.

Power tracks of this type that may be used with and are usual for such adapters are found for instance in DE-OS 22 50 738 (FIG. 3). This document also shows such an adapter.

In the prior art there are different types of such adapters. For instance, adapters are known in which two operating shafts are provided that are coaxially adjacent to and spaced apart from one another. A first operating shaft mechanically links the adapter to the power track and connects the neutral conductor to the power track, while the second operating shaft selects the phase so that the adapter, which is a part of the consumer, is selectively connected to one of the three phases of the power track.

Other embodiments of such adapters are known, as well. Only one operating shaft is provided in these. Both the mechanical linking of the adapter to the power track and the outward pivoting of all contacts is accomplished by this one operating shaft. A slide provided with this adapter is physically adjacent the operating shaft and makes it possible to select the phases using appropriate slide positions.

All of these embodiments have in common that they require relatively large amounts of space because either two parallel operating shafts must be provided in the housing of the adapter or just one operating shaft and the space for an appropriate slide for phase selection.

OBJECTS OF THE INVENTION

It is therefore an object of the present invention to provide an improved power-track adapter.

Another object is the provision of such an improved power-track adapter that overcomes the above-given disadvantages, in particular that permits a space-saving arrangement of the switching elements.

SUMMARY OF THE INVENTION

An adapter is intended use with a U-section longitudinally extending power track having a pair of side walls defining a transversely open slot and provided on the side walls with longitudinally extending main conductors transversely exposed in the slot and connected to phase and ground. The adapter has according to the invention a housing having a base adapted to fit in the slot and a head fixed relative to the base and adapted to fit outside the slot on the track so that an electrical device can be connected via the adapter to the conductors in the track. A first operating shaft extending along and pivotal about an axis in the housing carries contact fingers pivotal on rotation of the first shaft between a retracted position recessed in the base and a contacting position projecting from the base and, when the base is fitted to the slot, engaging the conductors. A second operating shaft extends along and is pivotal about the axis in the housing. A second switch assembly connected to the second shaft and operable thereby on rotation of the second operating shaft to connect and disconnect the contact fingers with the phase contacts on the housing.

This arrangement and design attains a particularly space-saving embodiment because although two operating shafts are still required, the two operating shafts are coaxial so that they connect to one another and the lateral space requirement for installing the operating shafts is minimized.

The adapter functions in that when the first operating shaft is actuated all of the contact fingers are pivoted out and the adapter is also mechanically locked in the power track. By rotating the second operating shaft it is possible to select the corresponding phase to which the consumer connected to the adapter should be connected.

To make manual operation easier, each operating shaft has a radially projecting, manually accessible actuating arm and may be rotated by actuating it.

It is also preferable that the first operating shaft has additional mechanical latching elements that when in the retracted position are retracted into the base and in the contact position are pivoted out of the base for locking on the power track.

Although such mechanical latching elements could also be provided in another manner, combining the latching elements and the first operating shaft is preferred. This ensures that once the adapter has been inserted into the appropriate power track and once the first operating shaft has been rotated, both the mechanical arresting occurs and the contacts are pivoted outward into the contact position. In addition, as is known per se in the prior art, projections or similar means may be provided on the adapter that make it possible to insert the adapter into a power track with no mistakes so that the adapter can only be inserted into the power track in one direction and not in a position rotated 180° from this direction.

One particularly preferred refinement is found in that for one power track that has two other electrical conductors in addition to three phase conductors and one neutral conductor, the adapter has additional contact fingers that are pivoted inward in the retracted position and pivoted outward in the contact position.

Conventional power tracks constructed like those in the above-described publication have two electrical conductors in each of the side walls of the power track, specifically two phase conductors in one side wall that are insulated and spaced apart from one another and one phase conductor and one neutral conductor in the other side wall.

To increase the field of use, a new bar is proposed that has two other electrical conductors in addition to the three phase conductors and the neutral conductor. These two electrical conductors are also preferably arranged in insulating bars between the two phase conductors in the one bar side and the phase conductor and the neutral conductor in the other bar side. All of the conductors are exposed in the retaining channel of the bar so that once the adapter has been inserted the appropriate connections can be made. An additional field of use is possible since, in addition to the contact fingers that can be connected to the phase conductors and the neutral conductor, the adapter also has two other conductors that likewise have contact fingers that can pivot in and out. For instance, using the additional electrical conductors it is possible to supply another voltage source. This may be a voltage source with standard line voltage or even with low voltage. It is also possible to interpose electronic circuits or similar elements. With respect to this electric conductor, no corresponding selection of different positions is necessary; rather, in the contact position these electrical conductors are in continuous electrical contact with the corresponding contact fingers.

Preferably the additional contact fingers are attached in the housing of the adapter and can be pivoted in and out by cams provided on the operating shaft by rotating the first operating shaft.

The additional contact fingers are thus also pivoted out of the retracted position into the contact position by one and the same operating element, specifically by the first operating shaft, or due to inherent tension are returned from the contact position to the retracted position when the first operating shaft is correspondingly rotated into the retracted position.

One particular preferred refinement is found in that the first operating shaft is rotatably held in the housing of the adapter and has an end plate, contact strips for three phase conductors and one neutral conductor exiting at the end plate of the operating shaft and forming first contact parts and on the cover opposing sides that are different distances from the end plate exiting and forming the contact fingers, and in that fixed beneath the end plate in the housing is a printed circuit board that has on its top side four first contacts for the first contact parts of the contact strips, three contacts being plated through the printed circuit board, and on the bottom side of the printed circuit board form three second contact sites and three third contact sites that act as phase connections for a consumer and that are spaced apart and insulated from the second contact sites, and in that beneath the printed circuit board, rotatably held thereto, is arranged the second operating shaft that acts as phase selection switch and has a contact bridge that in alternative rotary positions contacts a third contact site to a second contact site, and in that the fourth first contact that acts as a neutral conductor connection forms a connection site for a neutral conductor of a consumer.

This arrangement makes it possible to arrange the these parts in an extremely small space and still reliably perform all functions.

For the same reason the two additional electrical conductors are formed by resilient contact strips that are held in the housing and on an end area disposed in the housing form connection sites for another electrical device or an electrical control and a second end area that has contact fingers, the first operating shaft having bars or the like that act on the resilient contact strips and by means of which the contact fingers are pivoted out into the contact position.

BRIEF DESCRIPTION OF THE DRAWING

The above and other objects, features, and advantages will become more readily apparent from the following description, reference being made to the accompanying drawing in which.

DETAILED DESCRIPTION OF THE INVENTION

Figure 1:
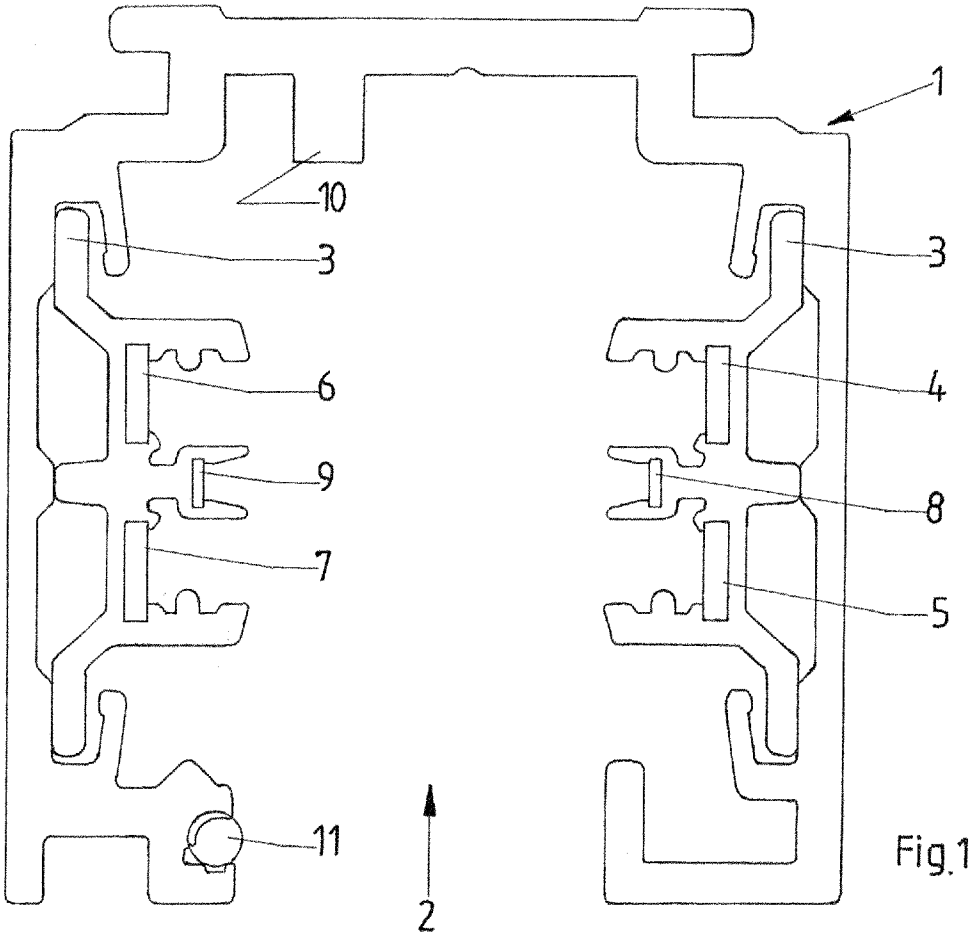
FIG. 1 is an end view of a U-section power track.

As seen in FIG. 1 a power track 1 made of metal is essentially of U-section. Support rails 3 made of insulating material are mounted on its parallel side walls and laterally delimit a retaining channel or slot 2. These support rails 3 each receive a plurality of uninsulated bare electrical conductors 4-7 that are insulated from one another, are arranged parallel to one another in the rail longitudinal direction, are opposite one another, and are exposed in the retaining channel. The conductors 4, 5, 6 may be phase conductors of a three-phase rotary current system, while the conductor 7 may be a neutral conductor for this system. Other conductors 8, 9, which are insulated from and mounted between respective pairs of 4, 5 and 6, 7 of conductors, may be used for instance as control conductors for an electrical or electronic control or may be used as additional power conductors for other electrical devices.

A ground conductor 10 is also provided on the floor of the power track 1. Additionally or alternatively, a ground conductor 11 may be provided on one side wall of the power track 1.

FIGS. 2-11 show an adapter 12 that is intended for use in the power track 1. To this end, the adapter 12 has a base 13 that may be inserted into the slot 2 of the power track 1 and a head 14 that sits outside the power track 1. The head 14 determines the insertion depth limit for the base 13, it being possible to provide on the power track and on the head 14 suitable elements that permit them to be relatively positioned correctly. For instance, to this end projections 53 may be provided on the head and recesses 54 may be provided asymmetrically on the power track 1, which projections 53 and recesses 54 only permit the adapter 12 to be used in one specific position.

The head 14 is suitable and intended for receiving or carrying an electrical device that may be connected electrically to the contacts of the adapter.

Provided in the adapter housing is a first operating shaft 15 that can pivot contact fingers 16, 17, 18, 19 outward for contacting the respective electrical conductors 4, 5, 6, 7 provided in the power track 1 in that by rotating the first operating shaft 15 these contact fingers 16 through 19 may be moved out of a retracted or inwardly pivoted retracted position into an outwardly pivoted contact position.

Figure 2:
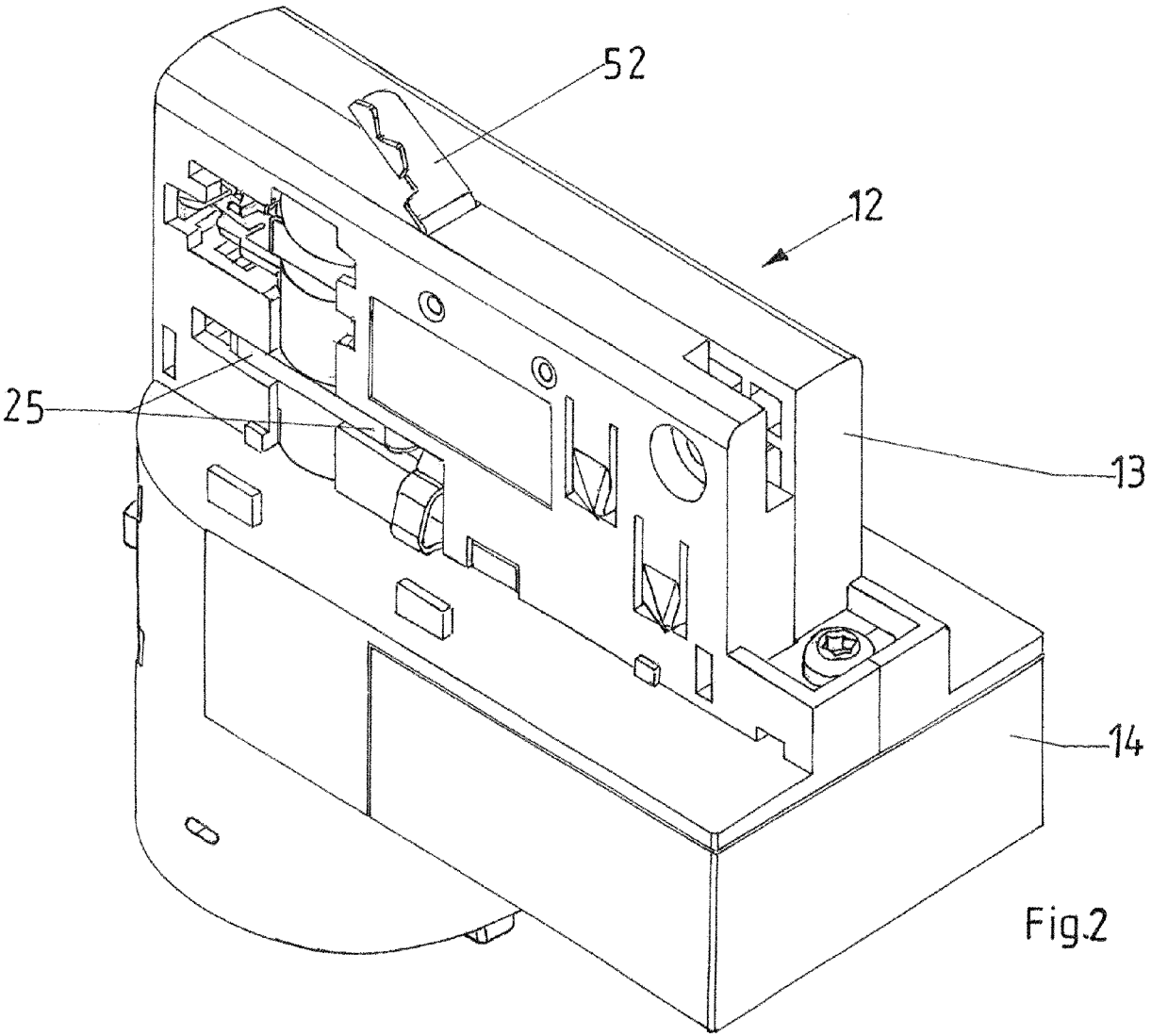
FIG. 2 is perspective view an adapter that fits it, shown in the retracted position in which the contact fingers and latching elements are pivoted inward.
Figure 3:
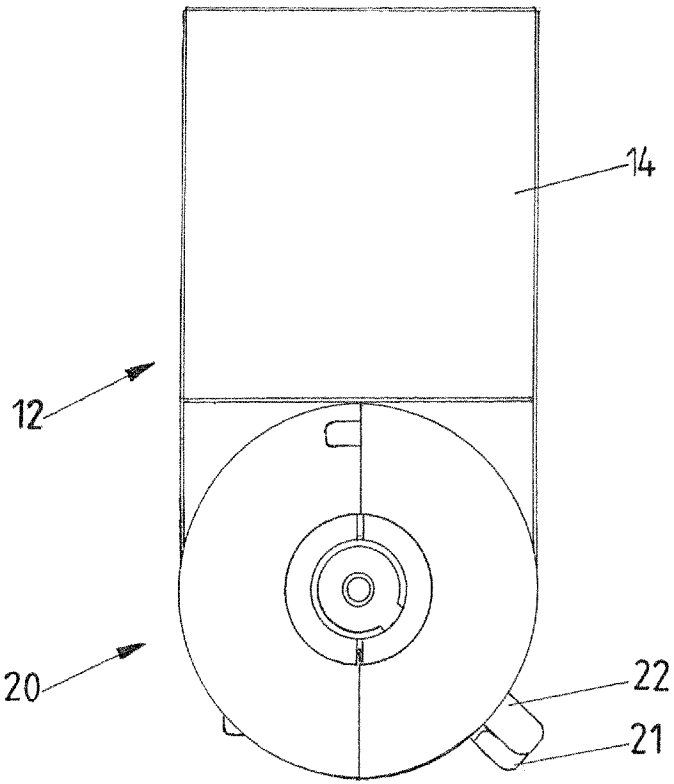
FIG. 3 is a bottom view of the adapter shown in FIG. 3.
Figure 5:
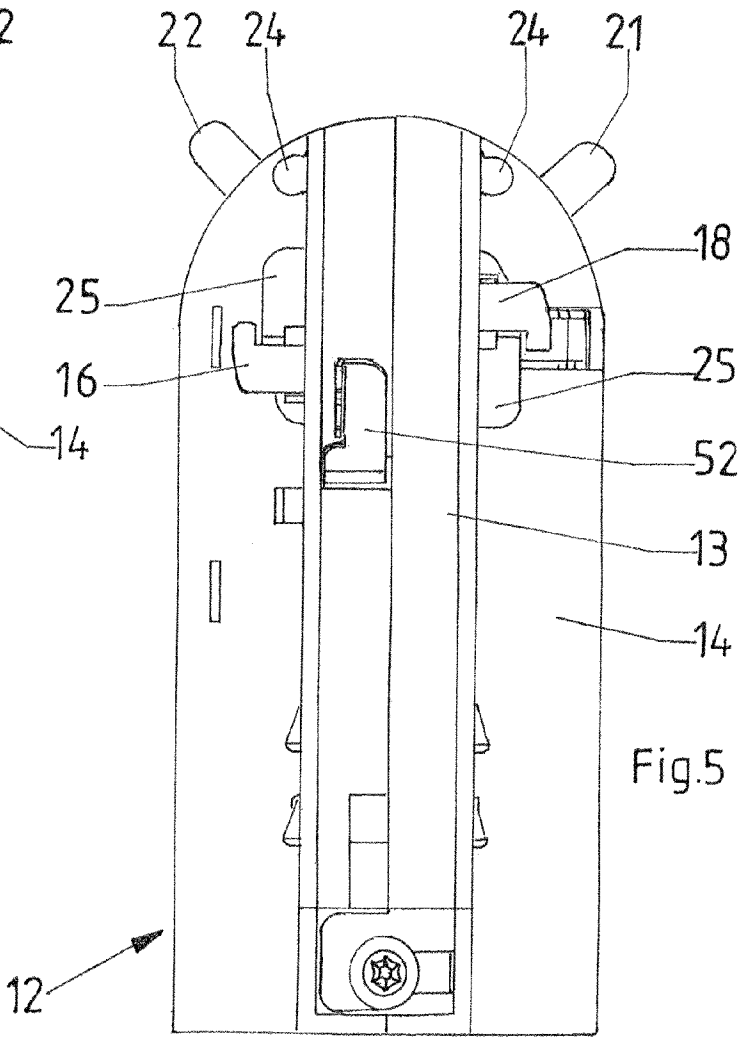
FIG. 5 is a top view of the adapter as in FIG. 4.
Figure 4:
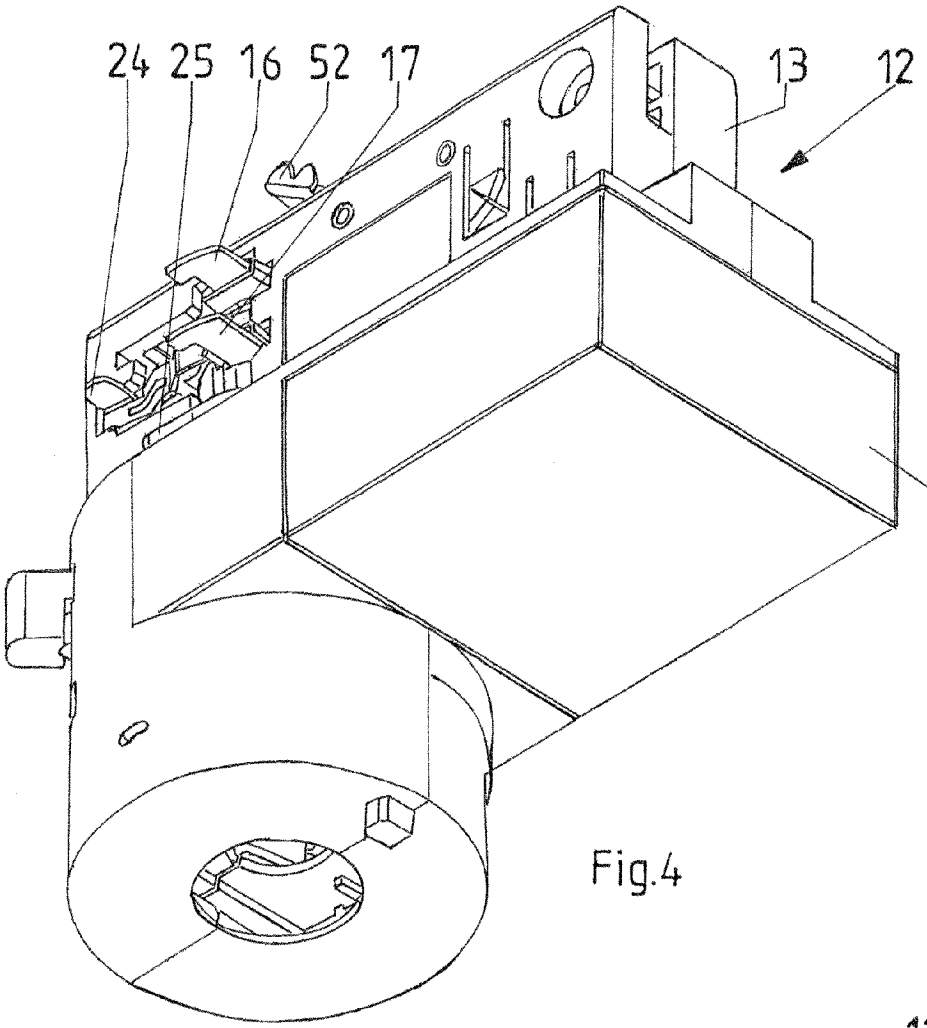
FIG. 4 is a perspective view of the adapter from below with the contact fingers moved into the contact position.
Figure 6:
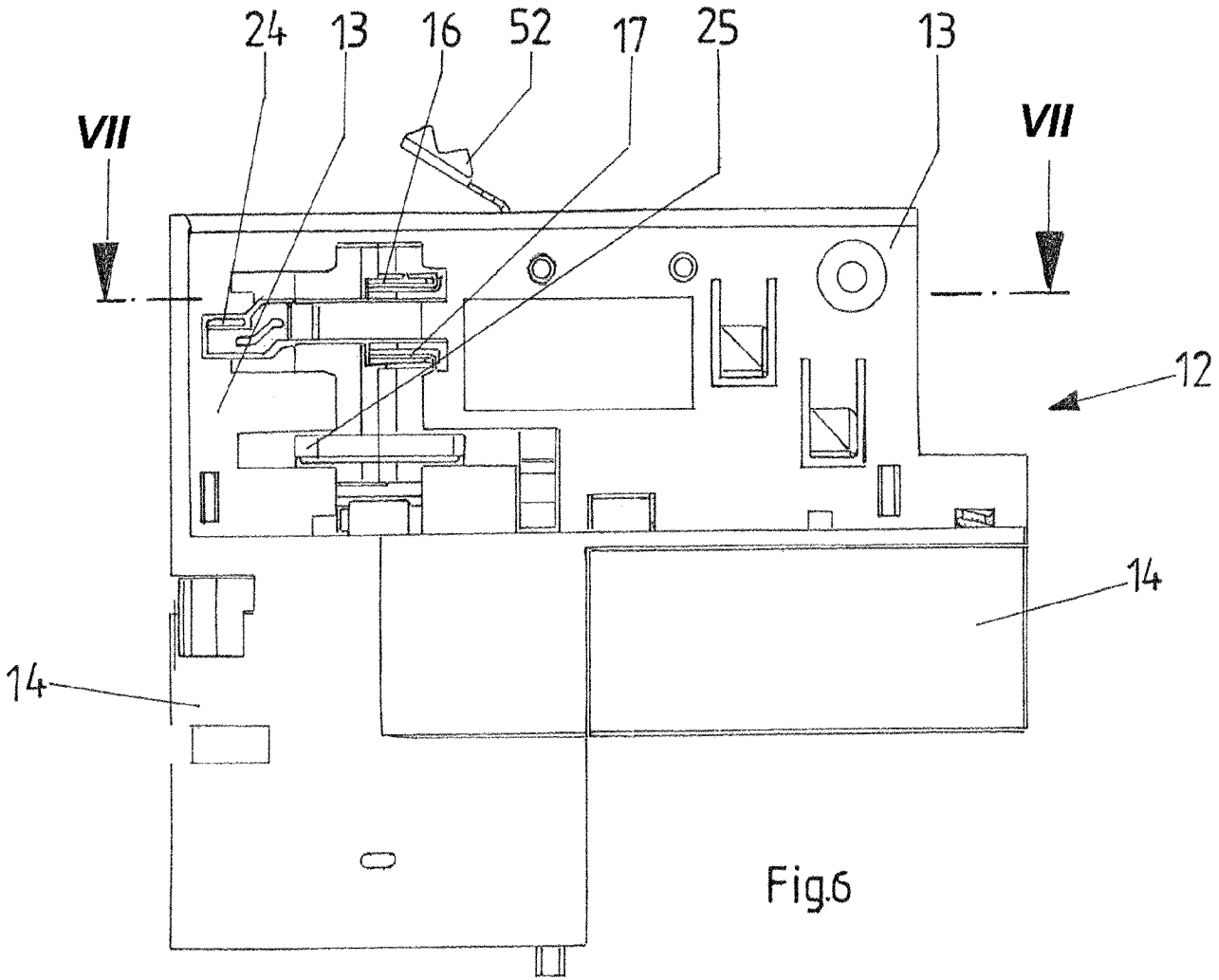
FIG. 6 is a side view of the adapter.

For instance, FIGS. 2 and 3 show the retracted position in which the contact fingers 16 through 19 are pivoted inward. FIGS. 4 through 6 show a position in which they are pivoted outward into the contact position. Moreover, the adapter 12 has a second switch assembly that can connect one of the phase connectors of the adapter selectively with one of the contact finger 16 through 18 that is on phase, the contact finger 19 always being on the neutral conductor contact.

In accordance with the invention, the second switch assembly is formed by a second operating shaft 20. This second operating shaft 20 is merely for phase selection and is coaxial with the first operating shaft 15 and is mounted thereon so that both may be rotated about the same axis independently of one another.

Each of the operating shafts 15, 20 has a respective radially projecting actuating arm 21, 22 that can be accessed manually from outside so that the user can rotate the first operating shaft 15 by actuating the actuating arm 21, and can rotate the second operating shaft 20 for phase selection by actuating the second actuating arm 22. Since in the power track 1 shown in FIG. 1 two other electrical conductors 8, 9 are provided in addition to the three phase conductors 4, 5, 6 and the neutral conductor 7, the adapter 12 correspondingly also has contact fingers 23, 24 that are pivoted inward in a retracted position and are pivoted outward in a he contact position. In the contact position all of the actuating arms pass through window-like cut-outs in the adapter housing.

The first operating shaft 15 has additional mechanical latching elements 25 that are rotationally fixed on the operating shaft 15 and in the retracted position are retracted into the base 13, as may be seen for instance in FIG. 2, and in the contact position are pivoted outward out of the base 13 for locking on the power track 1, as may be seen for instance in FIGS. 4 and 5.

Since the contact fingers 23, 24 that can be connected to the additional conductors 8, 9 of the power track 1 are not connected to three-phase rotary current, but rather are used as a control conductor or as line-power conductor systems, it is not necessary to actuate them using the phase selector as well, that is, using the second operating shaft 20.

Figure 7:
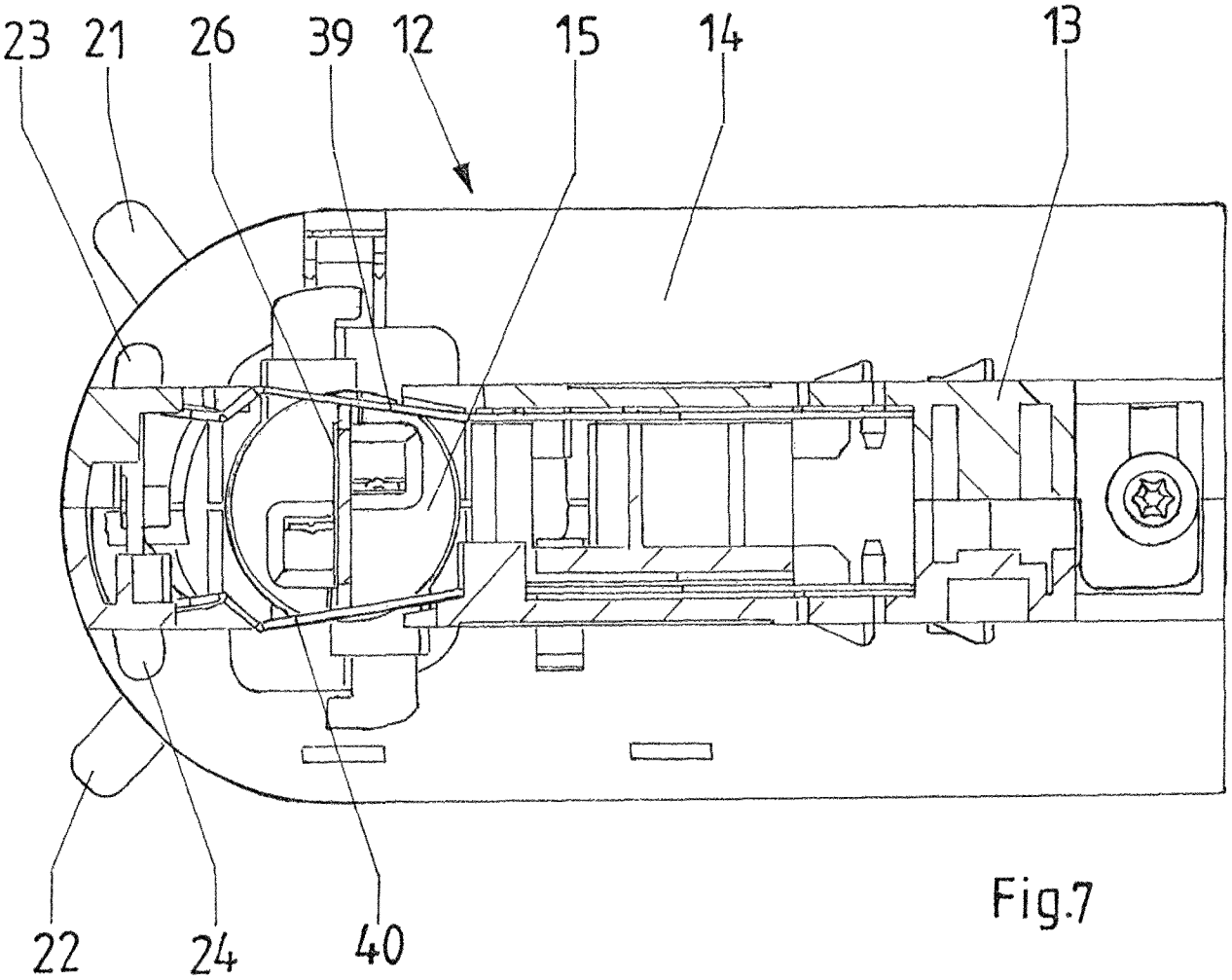
FIG. 7 is a section taken on line VII-VII of FIG. 6.
Figure 8:
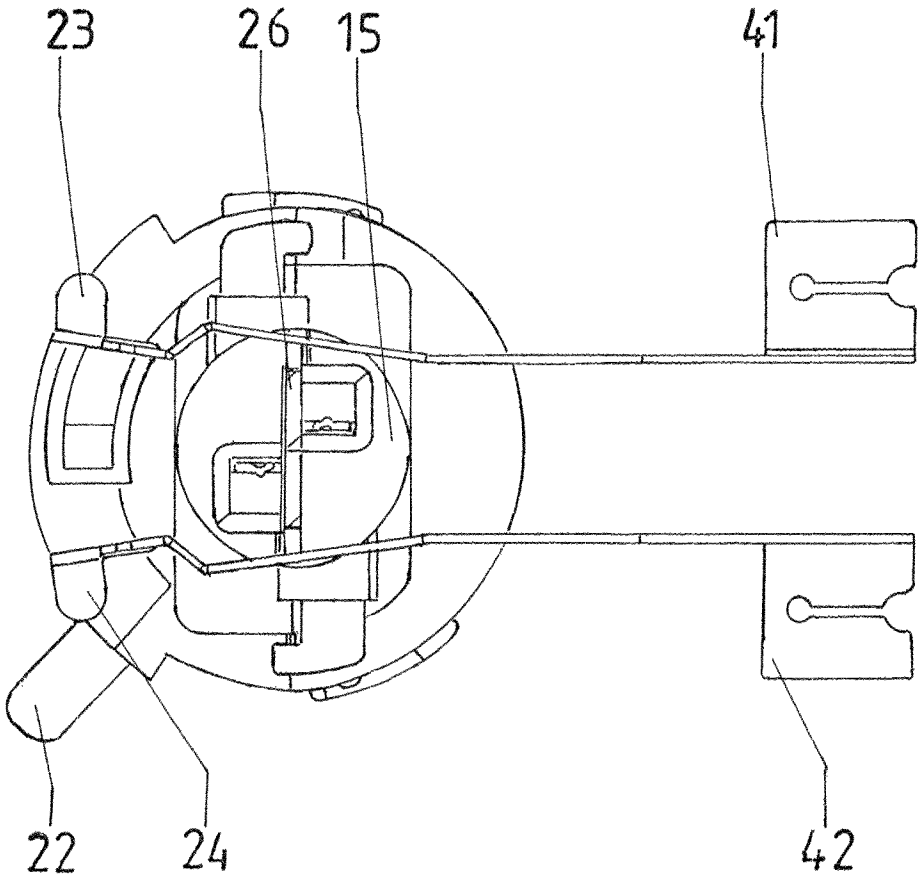
FIG. 8 is view of a detail of FIG. 7.

These additional contact fingers 23, 24 are attached in the housing of the adapter and may be spread by cams 26 provided on the first operating shaft 15, as may be seen in FIGS. 7 and 8. If the operating shaft 15 is rotated out of the retracted position into the contact position, the contact fingers 23, 24 are pivoted out of the base 13 of the adapter 12 by the cams 26. When the first operating shaft 15 is rotated back, the contact fingers 23, 24 return to the retracted position.

As has already been described, the first operating shaft 15 is rotatably held in the housing of the adapter 12. The first operating shaft has an end plate 27, contact strips for the three phase conductors and the neutral conductor and that have the contact fingers 16 through 19 projecting radially from the upper part of the operating shaft, while they are guided downward to below the end plate 27 and exit there, forming first contact parts 28 through 31. The contact fingers 16 through 19 project through the side wall of the first operating shaft 15 at different distances from the end plate 27 and on opposite sides.

A printed circuit board 32 is fixed beneath the end plate 27 in the housing. On its top side this printed circuit board 32 has four first contacts 33 through 36 that, at least when the first operating shaft 15 has been rotated into the contact position, contact the first contact parts 28 through 31 of the contact strips. The first contacts 33, 34, 35 intended for phase connection are plated through the printed circuit board 32 so that they can also be contacted on the bottom side of the printed circuit board 32. The first contact 36 is for instance the neutral conductor contact that does not have to be plated through, since it is always connected in a contacting manner to the corresponding contact finger 19 of the first operating shaft 15. Alternatively, the other first contacts 33, 34, 35 may be contacted. The second operating shaft 20 serves this purpose. As may be seen especially from FIG. 11, it carries a contact bridge 37 that may be repositioned resiliently and parallel to the rotation axis of the second operating shaft 20. Contacts provided below the printed circuit board 32 may be connected to one another by this contact bridge. These are three second contact sites that are directly connected to the first contacts 33, 34, and 35, and three third contact sites that act as phase connections for the consumer and that are spaced apart and insulated from the second contact sites. By rotating the phase selection switch, specifically the second operating shaft 20, the contacts associated with a phase may be connected to one another by the contact bridge 37 so that then a phase is switched to the consumer.

A latch element 38 may also be interposed between the second operating shaft 20 and the bottom side of the printed circuit board 32; it ensures that the contact bridge only latches in the three positions determined by the corresponding phases so that the user is able to precisely position the second operating shaft 20.

Figure 9:
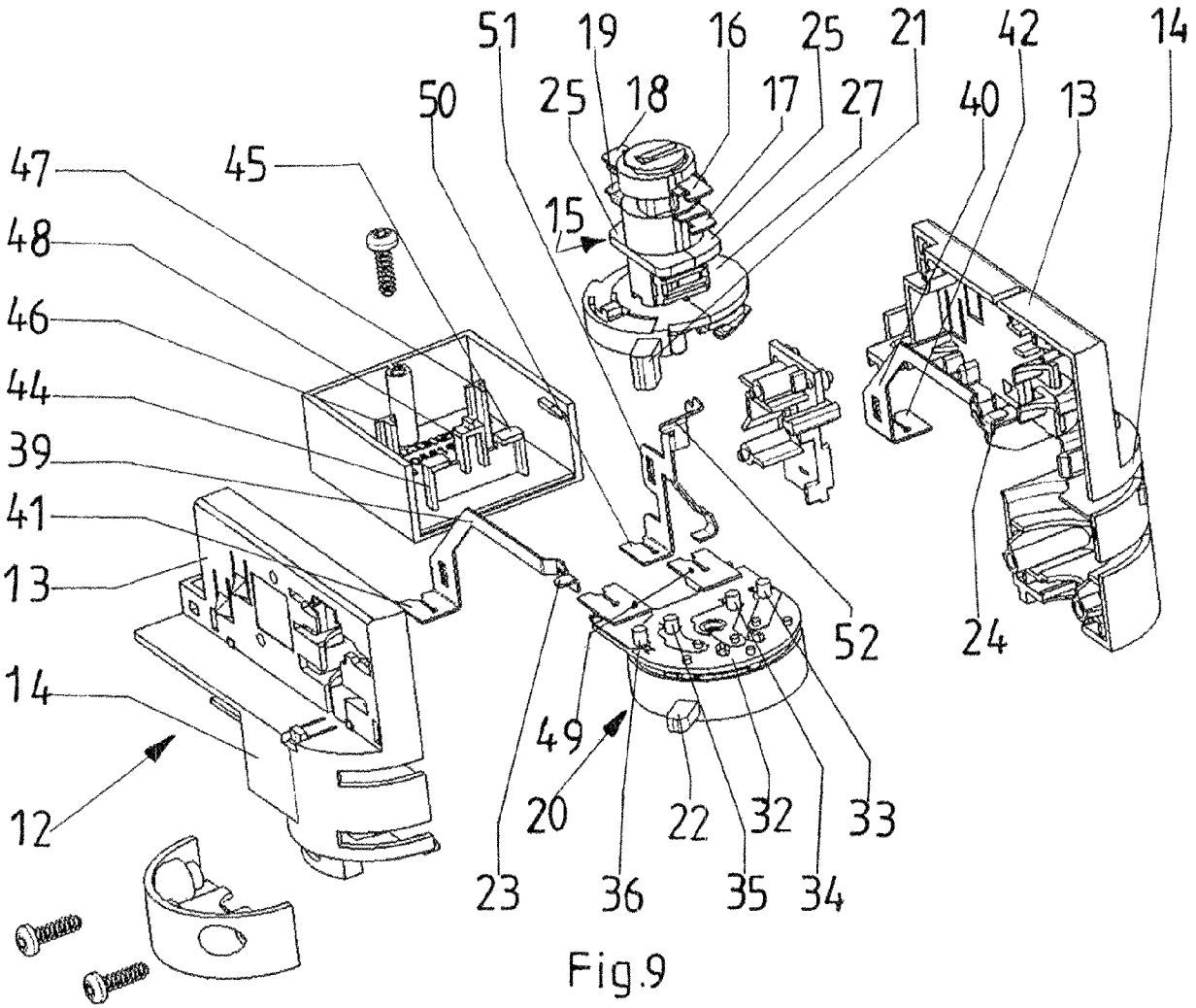
FIG. 9 is an exploded view of the adapter.
Figure 10:
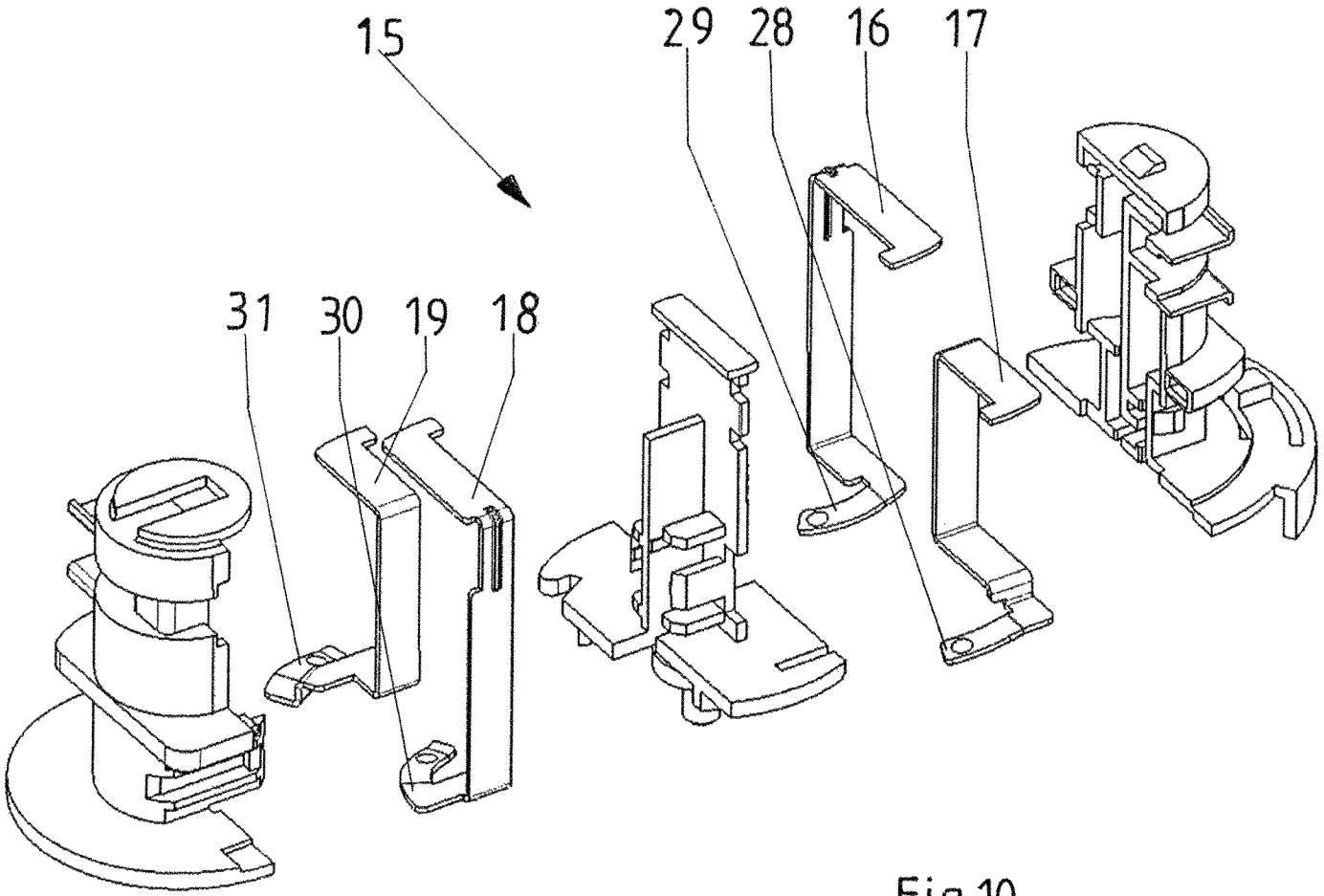
FIG. 10 is an exploded view of a detail of the adapter.
Figure 11:
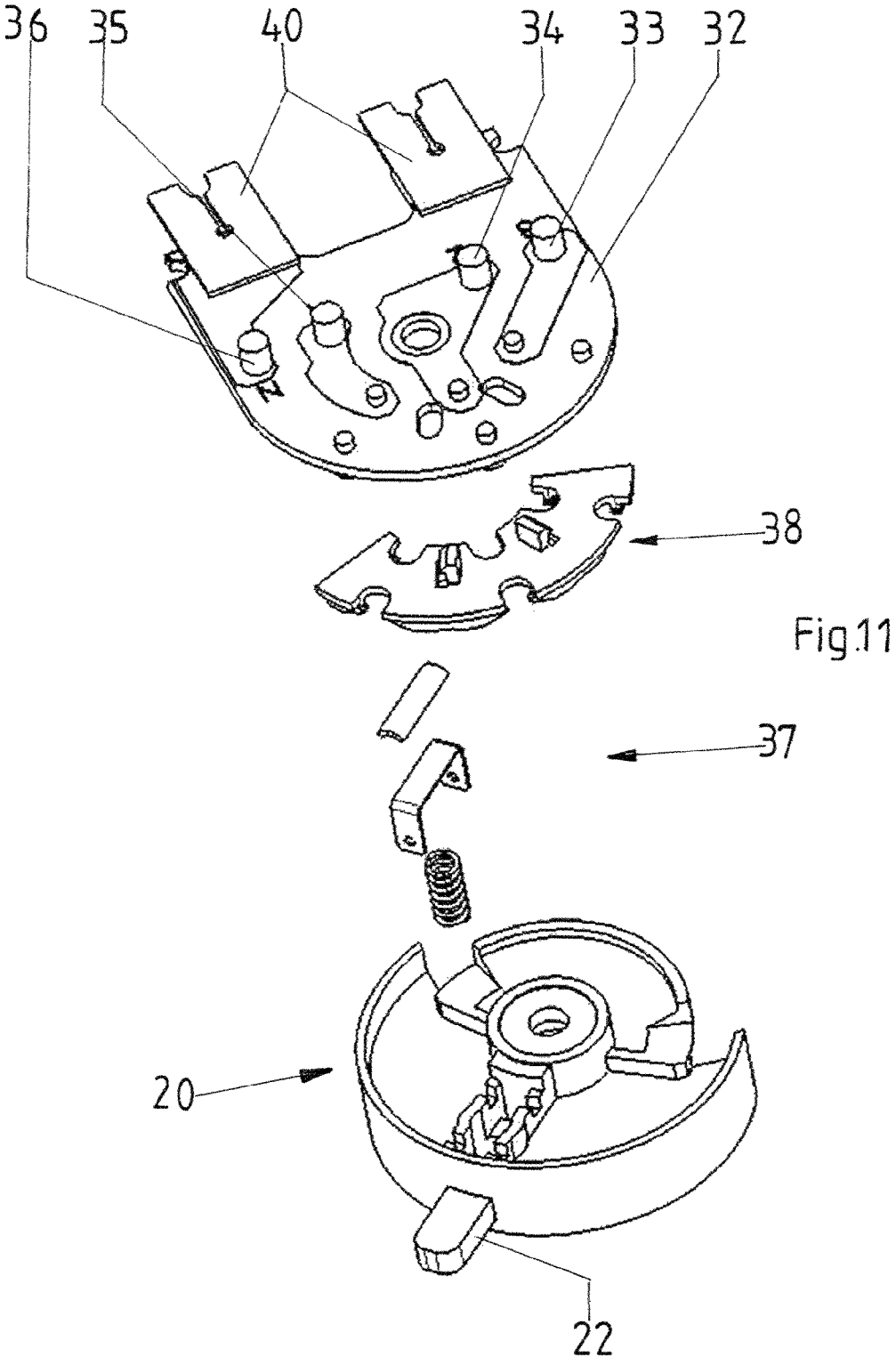
FIG. 11 is an exploded view of another detail of the adapter.

The two other electrical conductors that form or have the contact fingers 23, 24 are formed by resilient contact strips 39, 40 that may be seen especially in FIG. 9. They are held in the housing of the adapter 12 and at an end thereof in the housing have connection sites 41, 42 for an electrical device or an electrical control. A part 43 added to the housing of the adapter has bars 44 through 48, that each in the retracted position protect the insertion gap or area for conductors at the connection sites 41, 42, but also the other connection sites 49 on the printed circuit board and 50 on the ground conductor.

The ground conductor contact 51 is also held inside the adapter housing and exits as a resilient contact 52 at the top of the adapter 12.

The inventive embodiment is thus an adapter 12 that is simple and safe to operate, that requires a small amount of space for the switching elements, and that is extremely functional, especially even when not only is a three-phase current power track 1 being used, but also a power track 1 that has two additional conductor connections in addition to three phases and the neutral conductor.

The invention is not limited to the illustrated embodiment, but rather may vary widely within the context of the disclosure.

All of the individual and combined features disclosed in the description and/or drawing are considered essential to the invention.

I claim:

1. An adapter for use with a U-section longitudinally extending power track having a pair of side walls defining a transversely open slot and provided on the side walls with longitudinally extending main conductors transversely exposed in the slot and connected to phase and ground, the adapter comprising:

a housing having a base adapted to fit in the slot and a head fixed relative to the base and adapted to fit outside the slot on the track, whereby an electrical device can be connected via the adapter to the conductors in the track;

a first operating shaft extending along and pivotal about an axis in the housing and carrying contact fingers pivotal on rotation of the first shaft between a retracted position recessed in the base and a contacting position projecting from the base and, when the base is fitted to the slot, engaging the conductors;

a second operating shaft extending from the first operation shaft and also extending along and pivotal about the axis in the housing;

phase contacts on the housing; and a switch assembly connected to the second shaft and operable thereby on rotation of the second operating shaft to connect and disconnect the contact fingers with the phase contacts.

2. The adapter defined in claim 1, wherein each of the shafts is provided with a respective radially projecting, manually accessible actuating arm and can be rotated thereby.

3. The adapter defined in claim 1, further comprising:

latching elements on and pivotal with the first operating shaft, the elements being retracted into the base in the retracted position of the contact fingers and projecting from the base and latching the housing to the track.

4. The adapter defined in claim 1, wherein the power track has, in addition to the main conductors, longitudinally extending secondary conductors transversely exposed in the track, the adapter having additional contact fingers engageable with the secondary conductors.

5. The adapter defined in claim 4, wherein two additional electrical conductors are formed by resilient contact strips that are held in the housing and on an end area disposed in the housing form connection sites for another electrical device or an electrical control and a second end area that has contact fingers, the first operating shaft having bars or cams that act on the resilient contact strips and by means of which the contact fingers are pivoted out into the contact position.

6. The adapter defined in claim 4, wherein the first operating shaft is provided with cams that operate the additional contacts.

7. The adapter defined in claim 1 wherein the first operating shaft has an end plate carrying contact strips for three phase conductors and one neutral conductor exiting at the end plate and there forming first contact parts and on a cover opposite ends that are at different spacings from the end plate and form the contact fingers, the adapter further comprising:

a printed circuit board having an upper face provided with four first contacts for the first contact parts of the contact strips, three of the four first contact parts being plated through the printed circuit board and on a lower face of the printed circuit board forming three second contact sites and three third contact sites that act as phase connections for an electric device and that are spaced apart and insulated from the second contact sites, the second shaft being beneath the printed circuit board, rotatably held thereto, and having a contact bridge that in alternative rotary positions contacts a third contact site to a second contact site, and in that the fourth first contact that acts as a neutral conductor connection forms a connection site for a neutral conductor of the device.

* * * * *